US005241759A

United States Patent [19]

Weidlich et al.

[11] Patent Number: 5,241,759

[45] Date of Patent: Sep. 7, 1993

[54] APPARATUS FOR WIPING MOISTURE OFF THE SIDES OF RUNNING WEBS OF PHOTO-SENSITIVE MATERIAL

[75] Inventors: Dieter Weidlich; Lutz Beckmann; Jürgen Brunner; Ernst Schweiger, all of Munich, Fed. Rep. of Germany

[73] Assignee: Agfa-Gevaert Aktiengesellschaft, Leverkusen, Fed. Rep. of Germany

[21] Appl. No.: 744,946

[22] Filed: Aug. 14, 1991

[30] Foreign Application Priority Data

Sep. 22, 1990 [DE] Fed. Rep. of Germany ..... 4030060

[51] Int. Cl.[5] ..... F26B 19/00

[52] U.S. Cl. ..... 34/71; 34/14; 34/95; 15/100

[58] Field of Search ..... 34/242, 155, 95, 9, 34/152, 14, 69, 71, 70; 15/100

[56] References Cited

U.S. PATENT DOCUMENTS

| | | | |
|---|---|---|---|
| 2,739,338 | 3/1956 | Weeks | 15/100 |
| 2,807,891 | 10/1957 | Roscoe | 34/95 |
| 3,071,866 | 1/1963 | Mangus | 34/95 |
| 3,934,354 | 1/1976 | Hope et al. | 34/95 |
| 4,060,873 | 12/1977 | Leuchter | 15/100 |
| 4,117,604 | 10/1978 | Burg et al. | 34/95 |
| 4,142,301 | 3/1979 | Goodall | 34/41 |
| 4,601,112 | 7/1986 | Kush et al. | 34/95 |
| 4,706,325 | 11/1987 | Michelson | 15/100 |
| 4,773,580 | 9/1988 | Schweiger | 226/92 |
| 4,783,947 | 11/1988 | Posey et al. | 34/156 |
| 4,793,073 | 12/1988 | Leuchter | 34/156 |
| 4,837,593 | 6/1989 | Hehn | 354/322 |

FOREIGN PATENT DOCUMENTS 2048902 4/1972 Fed. Rep. of Germany .

*Primary Examiner*—Henry A. Bennet
*Assistant Examiner*—Denise L. F. Gromada
*Attorney, Agent, or Firm*—Peter K. Kontler

[57] ABSTRACT

Apparatus for wiping moisture off the sides of running webs of photosensitive material in developing machines employs one or more deformable elastic wiping elements in the form of elongated lips or rings which are maintained in contact with the respective side or sides of the running web. Each wiping element extends transversely of the path of the running web and is imparted a movement having a component in a direction transversely of the running web. This reduces the likelihood of extensive localized wear upon the wiping element or elements.

19 Claims, 3 Drawing Sheets

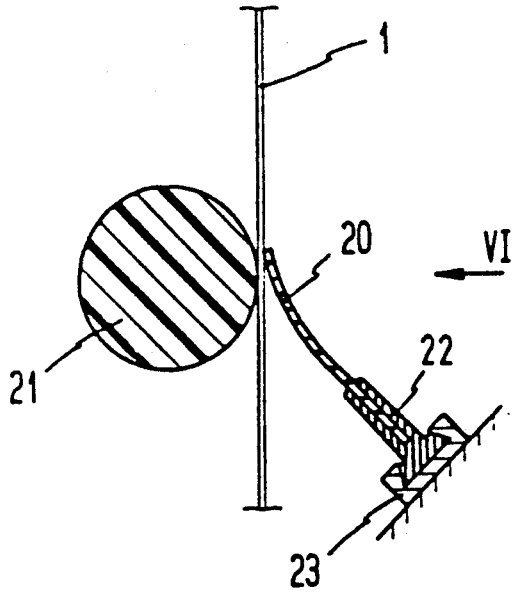
Fig.5
Fig.7
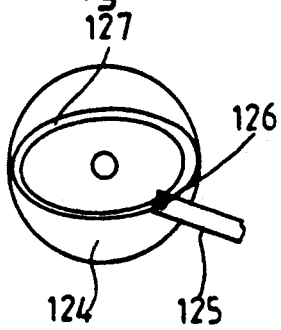
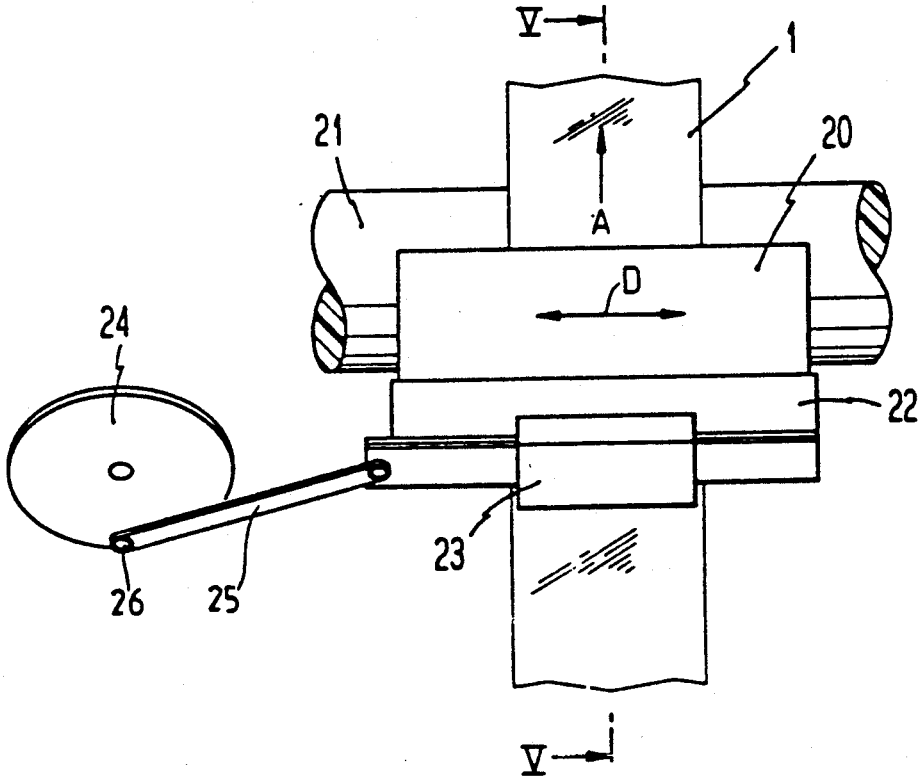
Fig.6

APPARATUS FOR WIPING MOISTURE OFF THE SIDES OF RUNNING WEBS OF PHOTO-SENSITIVE MATERIAL

BACKGROUND OF THE INVENTION

The invention relates to improvements in apparatus for removing contaminants (especially moisture) from the sides of running webs. More particularly, the invention relates to improvements in apparatus which can be used with advantage as a means for wiping contaminants off one or both sides of running webs of photographic paper or another wet processed photosensitive material. Still more particularly, the invention relates to improvements in apparatus of the type disclosed, for example, in commonly owned U.S. Pat. No. 4,793,073 to Leuchter.

It is customary to transport exposed webs of photographic paper through a series of baths wherein the sides of the running web are contacted by various fluids. For example, a web of photographic paper will normally advance through a developing bath, thereupon through a fixing bath, then through a rinsing bath and thereafter through one or more drying chambers. In order to prevent the web from entraining large quantities of a liquid from a preceding bath into the next-following bath, or from the last bath into the drying chamber, it is customary to advance the web through apparatus which are designed to wipe the sides of the web clean, i.e., to strip off at least a high percentage of moisture between two successive baths or between the last bath and the next-following treating station. In the absence of such undertakings, the fixing bath would be rapidly mixed with a progressively increasing percentage of developing solution, and the rinsing bath would receive a progressively increasing percentage of fixing solution. Moreover, the web would be likely to entrain a large quantity of rinsing liquid (e.g., water) into the adjacent drying station. All this would cause numerous problems necessitating frequent stoppages of the developing machine and resulting in a reduction of the quality of customer prints which are obtained as a result of subdivision of properly exposed and developed webs of photographic paper.

Published German patent application No. 20 48 902 describes a wiping or moisture removing apparatus which employs one or more stripping or wiping lips of rubber or other suitable elastomeric material. A drawback of such apparatus is that the relatively sharp marginal portions of the running webs rapidly remove substantial quantities of material from the adjacent portions of the lip or lips so that the lips are provided with notches which permit streaks of moisture to bypass the wiping apparatus and to enter the next bath or the drying station following the last bath. The situation is aggravated if a relatively narrow web is followed by a wider web because the notches which were formed by the marginal portions of a preceding (narrower) web are then adjacent the picture bearing portions of the next-following wider web or webs to seriously affect the quality of the pictures by changing the concentration of various substances in the next-following baths or by permitting streaks of moisture to overlie the picture bearing parts in the drying chamber or chambers. The situation is analogous if a lip which is already notched by a relatively narrow web is thereupon used to wipe excess moisture off the same web after the web has changed its path by having moved sideways so that one of its picture bearing portions entrains one or more streaks of liquid. The presence of excess moisture on those portions of a web of developed photographic paper which have advanced beyond the last bath and into the drying station or stations is particularly likely to adversely affect the quality of customer prints.

OBJECTS OF THE INVENTION

An object of the invention is to provide an apparatus which can reduce contaminants from one or both sides of a running web to a predictable extent and for long periods of use.

Another object of the invention is to provide an apparatus wherein the web contacting wiping element or elements are installed and operated in such a way that their useful life is much longer than that of wiping elements in heretofore known apparatus.

A further object of the invention is to provide the apparatus with novel and improved means for prolonging the useful life of the web-contacting wiping element or elements.

An additional object of the invention is to provide an apparatus wherein a single wiping element suffices to remove surplus moisture from both sides of a running web.

Still another object of the invention is to provide a developing machine for photographic paper or other photosensitive materials which embodies one or more apparatus of the above outlined character.

A further object of the invention is to provide a novel and improved method of prolonging the useful life of one or more web-contacting or wiping elements in the above outlined apparatus.

Another object of the invention is to provide the apparatus with novel and improved means for ensuring predictable and optimum wiping engagement of one or more wiping elements with the sides of a running web of photographic paper or the like.

SUMMARY OF THE INVENTION

The invention is embodied in an apparatus for wiping contaminants off at least one side of a running web which is advanced in a predetermined direction along a predetermined path, particularly for wiping moisture off at least one side of a running web of photographic paper. The improved apparatus comprises a web engaging device including at least one deformable wiping element which contacts the one side of the running web in the path and extends substantially transversely of the predetermined direction, and means for imparting to the at least one wiping element a movement having a component extending transversely of the predetermined direction.

The movement imparting means can comprise means for reciprocating the wiping element, e.g., an elastic blade or lip which extends substantially transversely of the path for the running web. The arrangement may be such that the at least one wiping element is moved substantially at right angles to the predetermined direction. The length of the wiping element (or the length of that portion of the wiping element which actually contacts the web while the web is caused to advance along the predetermined path and the at least one wiping element is moved transversely or substantially transversely of such path) can be at least twice the width of the running web. The reciprocating means can be designed to move the wiping element at an amplitude which equals or approximates the width of the running web. Such reciprocating means can comprise a crank drive, a cam and follower drive or any other suitable means for moving the at least one wiping element at the required frequency and/or amplitude.

The wiping element can include or constitute an annulus, e.g., a ring made of a deformable elastomeric material. The means for imparting movement to the annular wiping element can include at least two pulleys for the annulus, i.e., the annulus can be trained about two or more pulleys. Each of the at least two pulleys can be installed adjacent one marginal portion of the running web, and the apparatus can further comprise means (e.g., a rigid or yieldable back support) for biasing the annulus against the one side of the running web in the predetermined path. A reach or stretch of the annulus extends between the at least two pulleys and engages the one side of the running web, and the biasing means is then adjacent the stretch of the annulus to bias such stretch against the one side of the web. The stretch of the annulus can extend substantially at right angles to the predetermined direction, and the movement imparting means can include means for rotating at least one of the at least two pulleys. Alternatively, the structure including the pulleys and the annulus around them can be reciprocated transversely of the direction of advancement of the web along its path.

If the apparatus is to be designed to wipe contaminants off both sides of a running web, the device can comprise a plurality of annular wiping elements, e.g., at least one (but preferably at least two) at each side of the running web. The wiping elements can be staggered relative to each other in order to impart to the adjacent portion of the path a substantially undulate shape.

In lieu of using one or more discrete annular wiping elements at each side of the running web, it is also possible to cause the web to advance through the annular wiping element or elements so that a single annular wiping element or each of two or more annular wiping elements can contact both sides of the running web. Thus one stretch of each annular wiping element engages the at least one side and another reach or stretch of each annular wiping element contacts the other side of the running web. Means can be provided to bias the two stretches of each annular wiping element against the respective side of the running web.

The movement imparting means can be designed to move each wiping element at a speed which is less than the speed of movement of the web along its path. For example, the speed of the wiping element or elements can be in the range of 1–5 percent of the speed of forward movement of the running web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 5 is a sectional view substantially as seen in the direction of arrows from the line V—V in FIG. 6 and shows a portion of a third apparatus with a single lip-shaped reciprocable wiping element;

FIG. 6 is a view substantially as seen in the direction of arrow VI in FIG. 5; and FIG. 7 illustrates a different mechanism which can be used to reciprocate the lip in the apparatus of FIGS. 5 and 6.

DESCRIPTION OF PREFERRED EMBODIMENTS

Figure 2:
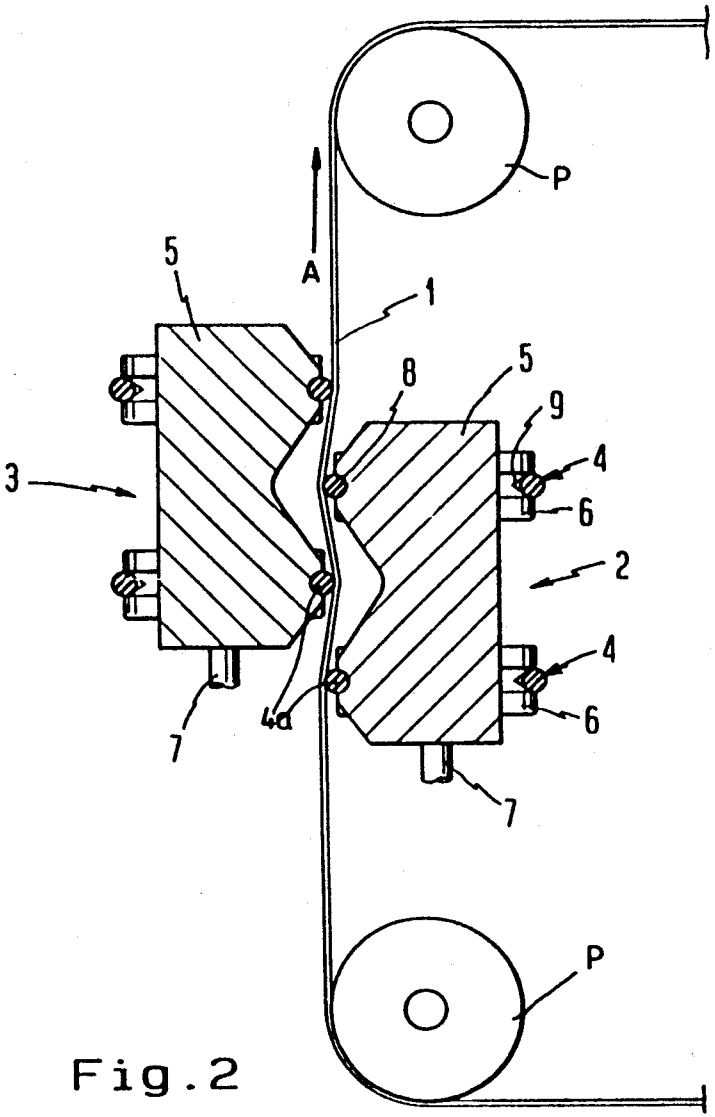
FIG. 2 is a sectional view substantially as seen in the direction of arrows from the line II—II in FIG. 1.
Figure 1:
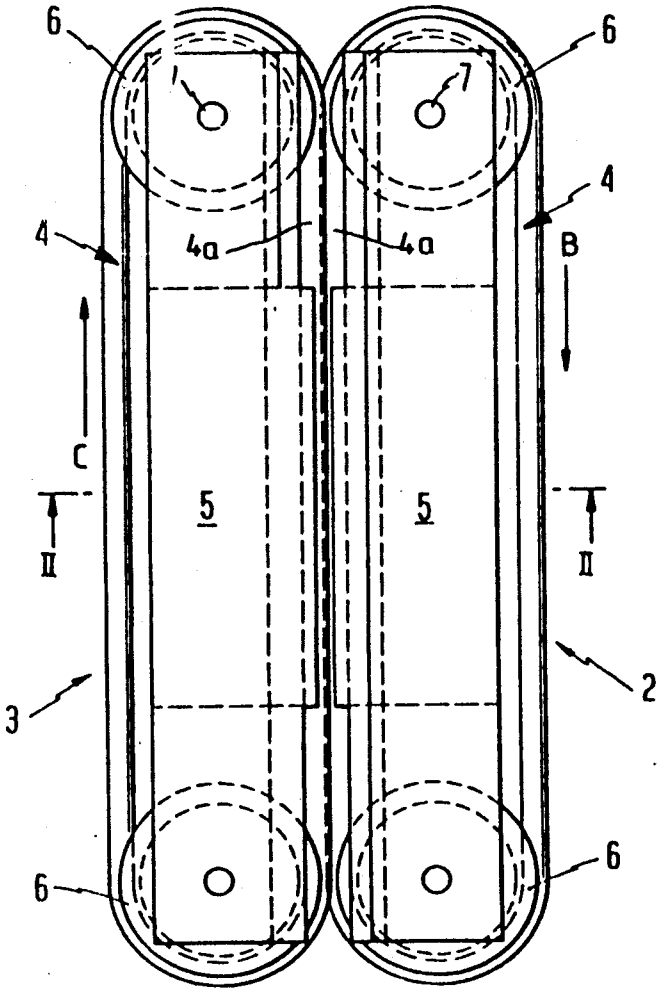
FIG. 1 is a plan view of an apparatus which embodies one form of the invention and employs a plurality of annular wiping elements at each side of the path for the running web.

FIGS. 1 and 2 show a first wiping apparatus which is designed to remove moisture from both sides of a running web 1 of photographic paper or other flexible strip-shaped material. The web 1 is advanced in or counter to the direction of arrow A in a direction at right angles to the plane of FIG. 1 between two pairs of elastically deformable annular wiping elements 4 (hereinafter called rings for short). The apparatus can be installed between a developing bath and a fixing bath, between a fixing bath and a rinsing bath or between a rinsing bath and a drying chamber of a photographic developing apparatus. Reference may be had, by way of example, to commonly owned U.S. Pat. No. 4,837,593 to Hehn which describes and shows a portion of a suitable developing machine with tanks one of which contains a supply of developing solution and the other of which contains a fixing bath. The purpose of the improved apparatus in the developing machine of Hehn can be to prevent developing solution from entering the fixing bath.

The apparatus of FIGS. 1 and 2 comprises two discrete or rigidly or movably interconnected wiping units 2 and 3 at opposite sides of the running web in the elongated path which is defined in part by pulleys P for the web. The manner in which the web 1 is advanced at a selected speed between the units 2, 3 in or counter to the direction of arrow A forms no part of the present invention. For example, the leader of the web 1 can be separably affixed to a clip of the type described and shown in commonly owned U.S. Pat. No. 4,773,580 to Schweiger. The clip is moved by a belt conveyor to draw the leader of the web 1 first through a developing tank, thereupon through the improved apparatus, thereupon through a fixing tank, thereupon through a second apparatus of the type shown in FIGS. 1 and 2, thereafter through a rinsing bath, followed (if necessary) by a third wiping apparatus, and thereupon into and through one or more drying chambers.

The improved wiping apparatus is mounted in or adjacent a developing machine in such a way that the unit 2 is located at one side and the unit 3 is located at the other side of the path of lengthwise movement of the web 1 between two successive baths or between the last bath and a drying station. Each of the units 2 and 3 comprises a substantially block-shaped support 5 for two pairs of pulleys or sheaves 6, one pair for each ring 4. At least one pulley 6 of each pair of pulleys on each of the supports 5 is driven by a shaft 7 deriving motion from a prime mover, not shown. The positions of the two block-shaped supports 5 are selected in such a way that the four pairs of rings 4 are staggered transversely of a straight line extending from the periphery of one of the pulleys P to the periphery of the other pulley P so that the four rings 4 define a substantially undulate or sinusoidal portion of the path for the web 1. Those portions of the supports 5 which are immediately adjacent the adjacent elongated stretches 4a of the rings 4 can be said to constitute back supports which serve to bias the stretches 4a of the respective rings 4 against the adjacent sides of the running web 1. This ensures that the stretches 4a reliably remove all or nearly all moisture from the respective sides of the web 1 before the freshly wiped increments of the web enter the next-following bath or a drying chamber, depending on the selected locus of the improved wiping apparatus in a developing machine.

The biasing portions of the supports 5 are provided with grooves 8 for the adjacent portions of inner stretches 4a of the respective rings 4. The grooves 8 reduce the likelihood of entrainment of the inner reaches or stretches 4a by the running web 1 when the improved apparatus is in actual use. Friction between the back supports or biasing means of the supports 5 and the adjacent inner reaches or stretches 4a of the rings 4 can be greatly reduced by coating the surfaces which surround the grooves 8 with a friction-reducing material (such as polytetrafluorethylene). On the other hand, it is desirable to enhance the friction between the rings 4 and the respective pairs of pulleys 6. To this end, the peripheral surfaces of the pulleys 6 are formed with circumferentially extending recesses or notches 9 each of which has a substantially triangular cross-sectional outline so that portions of the respective rings 4 are actually wedged in the respective notches or recesses 9. This ensures the establishment of a reliable frictional engagement, especially if the rings 4 are trained over the respective pairs of pulleys 6 in at least slightly stressed or expanded condition. The driven pulleys 6 then transmit motion to the respective rings 4, and the thus driven rings transmit motion to the idler pulleys 6. The surfaces bounding the recesses or notches 9 can be coated with films of friction generating or friction promotion material to further reduce the likelihood of slippage of the pulleys 6 relative to the respective rings 4 and/or vice versa.

The force with which the inner stretches 4a of the rings 4 bear upon the respective sides of the running web 1 can be adjusted by shifting at least one of the units 2, 3 toward or away from the other unit (to thus increase or reduce the amplitude of the sinusoidal path portion between the pulleys P) and/or by increasing or reducing the tensional stress upon the running web 1, e.g., with the aforediscussed clip.

In order to reduce the likelihood of lateral shifting of the web 1 in its path under the action of the adjacent stretches 4a which (in the embodiment of FIGS. 1 and 2) extend exactly at right angles to the direction (arrow A) of movement of the web 1, the rings 4 on the pulleys 6 of the unit 2 are preferably driven in a first direction B (e.g., clockwise, as seen in FIG. 1) whereas the reaches 4a of the rings 4 on the pulleys 6 of the unit 3 are driven in a counterclockwise direction C (again as seen in FIG. 1). This ensures that the web 1 does not tend to leave the sinusoidal path portion (by migrating toward or away from the observer of FIG. 2) even if the pulleys P are not formed with flanges which would enable them to act as the cores of reel-shaped guide members for the running web.

In the embodiment of FIGS. 1 and 2, the only component of movement which is imparted to any of the stretches 4a is at right angles to the direction of advancement of the web 1. Such movement ensures that the advancing web 1 cannot continuously rub against one and the same portion of each of the rings 4. On the contrary, the wear upon each of the four rings 4 is highly uniform because these rings are in continuous motion (at least while the developing machine embodying the improved apparatus is in actual use) so that the useful life of the rings 4 is long and the rings are not likely to develop notches or other depressions which develop when one uses conventional wiping apparatus wherein the web is caused to advance along one or more stationary wiping lips or the like. The development of notches in the exposed surfaces of the rings 4 would lead to development of streaks of liquid on those increments of the running web which advance beyond the rings 4, and such streaks of entrained liquid would contaminate the next-following bath or would adversely influence the drying action in the aforementioned drying chamber.

Highly satisfactory results were obtained when the rings 4 were driven at a speed of 0.2 to 0.5 m/min while the web 1 was advanced at a speed of at least 12 m/min. Thus, the speed of the rings 4 is much less than the speed of the web; the arrangement is preferably such that the speed of the rings 4 is between 1 and 5 percent of the speed of the web 1.

FIG. 1 shows that the length of the stretches 4a can greatly exceed the width of the running web 1. The pulleys 6 of each pair of pulleys are outwardly adjacent the respective marginal portions of the web 1. The stretches 4a need not extend exactly at right angles to the direction (arrow A) of advancement of the web 1, as long as they are in contact with the respective sides all the way between the two marginal portions of the web. Furthermore, it often suffices to employ a single ring 4 at each side of the web 1 but it is equally possible to employ three or more rings at one or both sides of the web. The moisture which is wiped off by the reaches 4a of the rings 4 can be withdrawn by suction or is evacuated by gravity flow.

Figure 3:
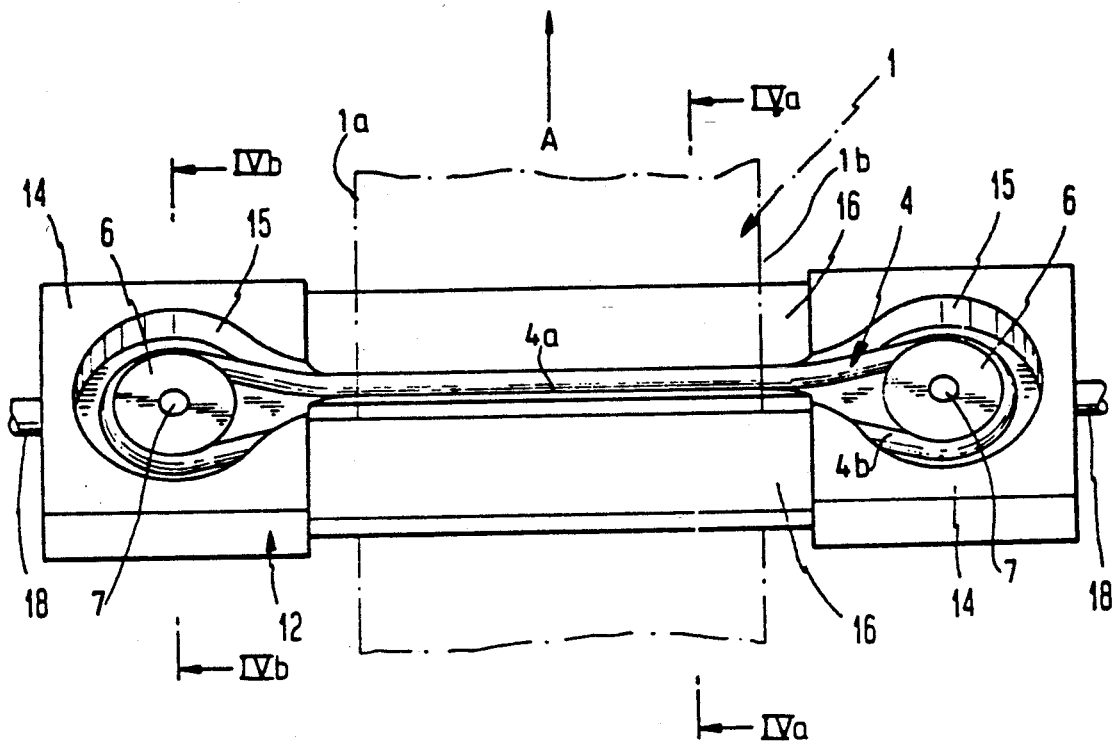
FIG. 3 is a view substantially as seen in the direction of arrow III in FIG. 4*a* and illustrates a second apparatus with a single annular wiping element which removes contaminants from both sides of the running web.
Figure 4B:
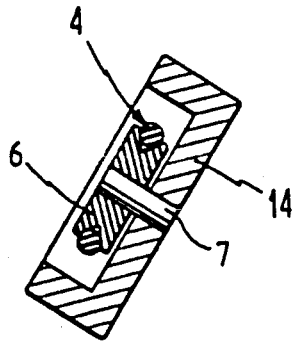
FIG. 4*b* is a sectional view substantially as seen in the direction of arrows from the line IV*b*—IV*b* in FIG. 3.
Figure 4A:
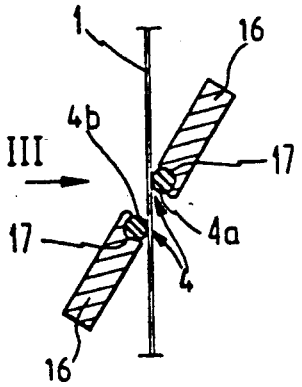
FIG. 4*a* is a sectional view substantially as seen in the direction of arrows form the line IV*a*—IV*a* of FIG. 3.

FIGS. 3, 4a and 4b show a portion of a second apparatus wherein a single annular wiping element or ring 4 suffices to wipe moisture off both sides of the running web 1 (indicated in FIG. 3 by phantom lines). The web 1 can be advanced to move in or counter to the direction of arrow A. Successive increments of the advancing web 1 move between the two parallel stretches 4a, 4b of the single ring 4. The latter is trained over two pulleys 6 which are outwardly adjacent the respective marginal portions 1a, 1b of the running web 1. At least one of the pulleys 6 is driven by the respective shaft 7 so that the stretches 4a, 4b move transversely of the direction which is indicated by the arrow A, for example, exactly at right angles to such direction.

The shafts 7 for pulleys 6 are mounted in a frame or housing 12 which includes two end portions 14 each of which mounts one of the pulleys 6. The end portions 14 are connected to each other by two parallel portions 16 which define a gap (FIG. 4a) for the web 1 and for the reaches 4a, 4b of the ring 4. In addition, the housing portions 16 constitute back supports which bias the respective stretches 4a, 4b against the corresponding sides of the running web 1. FIG. 4a further shows that the two connecting portions or back supports 16 are adjacent the path portion between the stretches 4a, 4b but do not come in actual contact with the running web 1. Those edge faces of the connecting portions 16 which are immediately adjacent and bias the respective stretches 4a, 4b are provided with guide grooves 17 for the respective sections of the ring. This ensures that the stretches 4a, 4b are not likely to leave their optimum positions relative to the adjacent sides of the running web 1. The ring 4 can constitute a commercially available O-ring of soft elastomeric material.

In order to facilitate the threading of the leader of a fresh web 1 into the gap between the connecting portions or back supports 16 of the housing 12, the end portions 14 of the housing 12 are preferably provided with coaxial stubs 18 which define a pivot axis for the housing 12. If the housing 12 is turned in a clockwise direction, as seen in FIG. 4a, the gap between the reaches or stretches 4a, 4b extends substantially at right angles to the plane of the web 1 so that the latter can be conveniently advanced along that path portion which extends between the stretches 4a and 4b. The housing 12 is then pivoted back to the position of FIGS. 4 and 4a so that the running web 1 is compelled to engage the stretches 4a, 4b and is thus relieved of moisture at each of its sides.

The web 1 can be caused to advance through two or more successive apparatus of the type shown in FIGS. 4, 4a and 4b. This ensures even more reliable removal of all or nearly all moisture before the thus demoisturized increments of the web 1 enter the next bath, the drying station or one of several successive drying stations.

The connecting portions 16 cooperate to impart to the ring 4 the shape of an elongated narrow rectangle with enlarged rounded ends at the locations where the ring 4 is trained over the pulleys 6. The apparatus of FIGS. 3, 4a and 4b can employ one or two driven shafts 7, i.e., it is possible to drive only one of the pulleys 6 (so that the other pulley is driven by the ring 4) or to drive each of these pulleys.

It is further possible to modify the apparatus of FIGS. 3, 4a and 4b in such a way that the web 1 is not advanced between the stretches 4a, 4b but is outwardly adjacent one of these stretches. If it is necessary to wipe both sides of the running web, the thus modified apparatus of FIGS. 3, 4a and 4b will employ a second support 12 with a second ring 4 which engages the other side of the web.

FIGS. 5 and 6 show a portion of a third apparatus wherein one of the wiping elements is an elongated strip-shaped elastically deformable lip 20 and the other wiping element is a stationary or axially reciprocable roll 21 of preferably rigid plastic material which is not subject to rapid wear. The free longitudinally extending marginal portion of the lip 20 engages the adjacent side of the running web 1, and the roll 21 contacts the other side of the web 1 opposite the free marginal portion of the lip 20. The other marginal portion of the lip 20 is preferably releasably held (e.g., clamped) in an elongated holder 22 which is reciprocable in a stationary guide 23. The latter can be mounted in the developing machine, e.g., between two neighboring tanks for different liquids (such as a developing bath and a fixing bath or a fixing bath and a rinsing bath).

The roll 20 performs two important and desirable functions, i.e., it serves as a back support which biases one side of the web 1 against the free marginal portion of the lip 20, and it further serves to remove at least some moisture from the adjacent side of the web. In addition, the roller 21 renders it possible that the lip 20 exhibit a certain stiffness, i.e., that the free marginal portion of the lip can bear against the adjacent side of the web 1 with a certain force without risking undue deflection of the web portion which is being wiped by the lip 20 because such portion of the web is propped by the roll 21.

The means for imparting to the lip 20 a reciprocatory or oscillatory movement transversely of the direction (arrow A) of forward movement of the web 1 comprises a crank drive having a rotary eccentric 24 and a link 25 which couples the eccentric with the holder 22.

The width of the web 1 is or can be less than one-half the length of the free marginal portion of the lip 20. When the lip 20 is reciprocated (arrow D) by the crank drive 24, 25, each point of its free marginal portion contacts the web 1 only at the respective side of a central symmetry plane which halves the web and extends vertically, as seen in FIG. 6. In order to ensure uniform wear upon the entire length of the free marginal portion of the lip 20 (which is assumed to have a length approximately twice the width of the web, the diameter of the eccentric 24 equals or approximates the width of the web (it being assumed here that the pin 26 which articulately connects the link 25 to the eccentric 24 is located at or close to the periphery of the eccentric).

If desired, the crank drive of FIG. 6 can be replaced with a cam and follower drive a portion of which is shown in FIG. 7. The cam 124 is a groove cam having an endless cam groove 127 for a follower 126 at the adjacent end of the link 125. Other types of means for reciprocating the lip 20 can be used with equal or similar advantage.

An important advantage of the improved apparatus is that the wiping element or elements are in motion during removal of moisture from one or both sides of a running web. Therefore, the wear on such wiping element or elements is more uniform and the useful life is much longer than that of wiping elements in conventional apparatus. Thus, the web-contacting portion or portions of the wiping element or elements are highly unlikely to develop notches as a result of excessive or extensive localized wear due to continuous contact with the relatively sharp marginal portions of a web of photographic paper or the like. The reason is that the marginal portions of the running web do not always contact one and the same portion of the adjacent wiping element. Thus, highly desirable distribution of wear is ensured even if the speed of movement of each wiping element transversely of the path of movement of the running web is very low, such as between 1 and 5 percent of the speed of forward movement of the web.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for wiping contaminants off at least one side of a running web of exposed photosensitive material which is driven to advance in a predetermined direction along a predetermined path at a predetermined speed, comprising a web engaging device including at least one elastomeric wiping element which contacts the at least one side of the running web in said path and extends substantially transversely of said direction; and means for imparting to said at least one wiping element a movement having a component extending transversely of said predetermined direction, said movement imparting means including means for moving said at least one wiping element at a second speed which is less than said predetermined speed.

2. The apparatus of claim 1, wherein said movement imparting means comprises means for reciprocating said at least one wiping element.

3. The apparatus of claim 2, wherein said reciprocating means includes means for moving said at least one wiping element substantially at right angles to said direction.

4. The apparatus of claim 3 for wiping contaminants off a running web having a predetermined width, wherein said at least one wiping element has a length which is at least twice said predetermined width.

5. The apparatus of claim 4, wherein said reciprocating means includes means for moving said at least one wiping element at an amplitude which equals or approximates said predetermined width.

6. The apparatus of claim 2, wherein said reciprocating means comprises a crank drive.

7. The apparatus of claim 2, wherein said reciprocating means comprises a cam and follower drive.

8. The apparatus of claim 1, wherein said at least one wiping element includes an annulus.

9. The apparatus of claim 8, wherein said movement imparting means includes at least two pulleys for said annulus.

10. The apparatus of claim 9 for wiping contaminants off at least one side of a running web having two spaced-apart marginal portions, wherein each of said at least two pulleys is adjacent a discrete marginal portion of the running web in said path.

11. The apparatus of claim 9, further comprising means for biasing the annulus against the at least one side of the running web in said path.

12. The apparatus of claim 11, wherein said annulus includes a stretch which extends between said at least two pulleys and is immediately adjacent the at least one side of the web in said path, said biasing means including a back support for said stretch of said annulus.

13. The apparatus of claim 9, wherein said annulus has an elongated web contacting stretch extending between said at least two pulleys substantially at right angles to said direction and said movement imparting means comprises means for rotating at least one of said pulleys.

14. The apparatus of claim 8 for wiping contaminants off both sides of a running web, wherein said device comprises a plurality of annular wiping elements at each side of the web in said path.

15. The apparatus of claim 14, wherein said device comprises two annular wiping elements at each side of said path.

16. The apparatus of claim 14, wherein said wiping elements are staggered relative to each other to impart a substantially undulate shape to the adjacent portion of said path.

17. The apparatus of claim 8 for wiping contaminants off both sides of a running web in said path, wherein said annulus has a first stretch which contacts the at least one side and a second stretch which contacts the other side of the web in said path.

18. The apparatus of claim 17, further comprising means for biasing said stretches against the respective sides of the web in said path.

19. The apparatus of claim 1, wherein said second speed is between substantially 1 and 5 percent of said predetermined speed.

* * * * *